US012338998B2

(12) United States Patent
Barozzi

(10) Patent No.: US 12,338,998 B2
(45) Date of Patent: Jun. 24, 2025

(54) BURNER

(71) Applicant: BECKETT THERMAL SOLUTIONS S.R.L., Modena (IT)

(72) Inventor: Luca Barozzi, Modena (IT)

(73) Assignee: BECKETT THERMAL SOLUTIONS S.R.L., Modena (IT)

( * ) Notice: Subject to any disclaimer, the term of this patent is extended or adjusted under 35 U.S.C. 154(b) by 398 days.

(21) Appl. No.: 17/746,521

(22) Filed: May 17, 2022

(65) Prior Publication Data

US 2022/0364726 A1 Nov. 17, 2022

(30) Foreign Application Priority Data

May 17, 2021 (IT) ..... 102021000012668

(51) Int. Cl.
*F23N 5/24* (2006.01)
*F23D 14/02* (2006.01)
*F23D 14/70* (2006.01)

(52) U.S. Cl.
CPC ..... *F23N 5/242* (2013.01); *F23D 14/02* (2013.01); *F23D 14/70* (2013.01);
(Continued)

(58) Field of Classification Search
CPC .. F23D 14/02; F23D 14/70; F23D 2203/1012; F23D 2203/1017; F23D 2203/1026; F23N 5/242
(Continued)

(56) References Cited

U.S. PATENT DOCUMENTS 3,168,133 A * 2/1965 Zoschak ..... F23Q 3/008 431/263
2010/0316965 A1* 12/2010 Le Mer ..... F23D 14/02 431/12

(Continued)

FOREIGN PATENT DOCUMENTS

EP 3 495 735 A1 6/2019
EP 3 680 552 A1 7/2020
WO WO-2011082924 A2 * 7/2011 ..... F23D 14/34

OTHER PUBLICATIONS

WO-2011082924-A2—Translation (Year: 2011).*
Italian Search Report for Italian Patent Application No. 102021000012668 mailed Jan. 27, 2022, 8 pages.

*Primary Examiner* — Steven B McAllister
*Assistant Examiner* — Benjamin W Johnson
(74) *Attorney, Agent, or Firm* — Merchant & Gould P.C.

(57) ABSTRACT

A burner includes a diffuser wall delimiting an inner space in flow communication with an inlet passageway and forming a diffuser perforation for the gas mixture to pass from the inner space to an outer side of the diffuser wall where combustion occurs. A pilot chamber is formed in the inner space and delimited by a pilot portion of the diffuser wall, forming a pilot perforation, and by a pilot wall extended into the inner space. The pilot chamber forms pilot inlet openings supplying air/gas-air pre-mixture into the pilot chamber. A pilot gas opening supplies non-premixed fuel gas into the pilot chamber. A main chamber formed in the inner space is delimited by a diffuser wall main portion, forming a main perforation, and by the pilot wall. The main chamber delimits a main inner volume and is in flow communication with the inlet passageway to supply air/gas-air pre-mixture.

16 Claims, 4 Drawing Sheets

(52) U.S. Cl.
CPC ..... *F23D 2203/1012* (2013.01); *F23D 2203/1017* (2013.01); *F23D 2203/1026* (2013.01)

(58) Field of Classification Search
USPC ..... 431/14
See application file for complete search history.

(56) References Cited

U.S. PATENT DOCUMENTS

| | | | | |
|---|---|---|---|---|
| 2013/0252186 | A1 | 9/2013 | Jin et al. | |
| 2021/0199289 | A1* | 7/2021 | Benvenuto | F23N 5/022 |

* cited by examiner

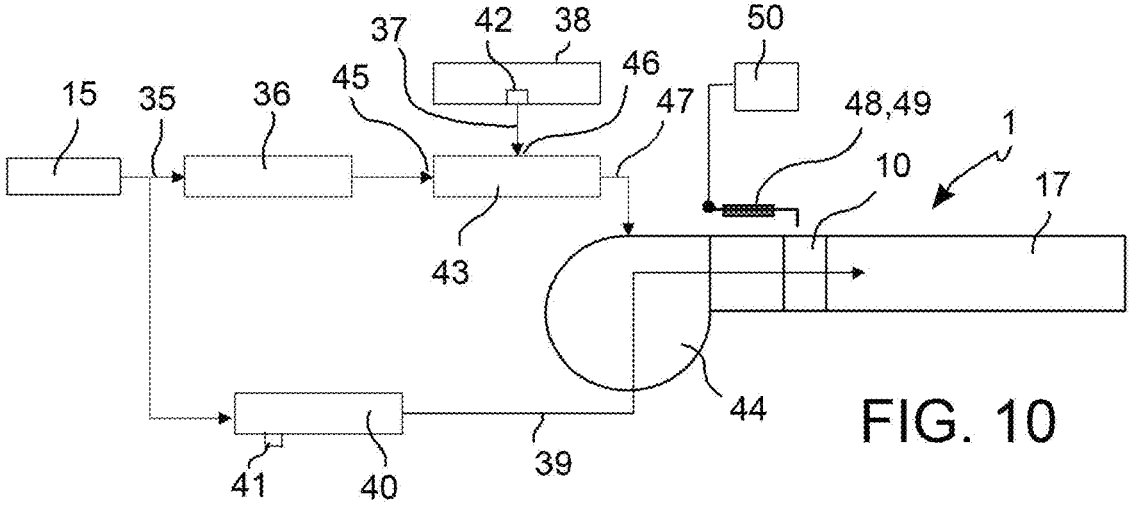
FIG. 10
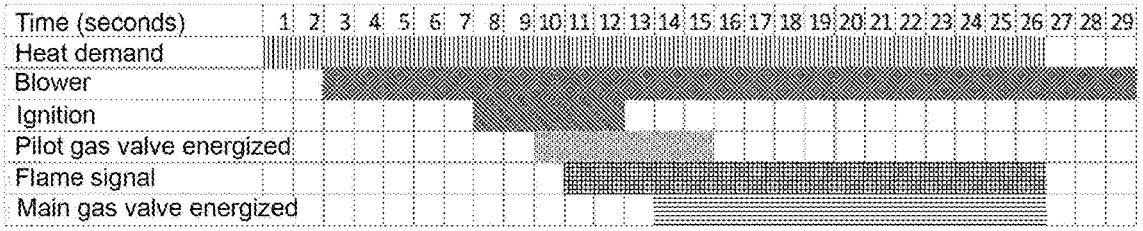
FIG. 10A
FIG. 9
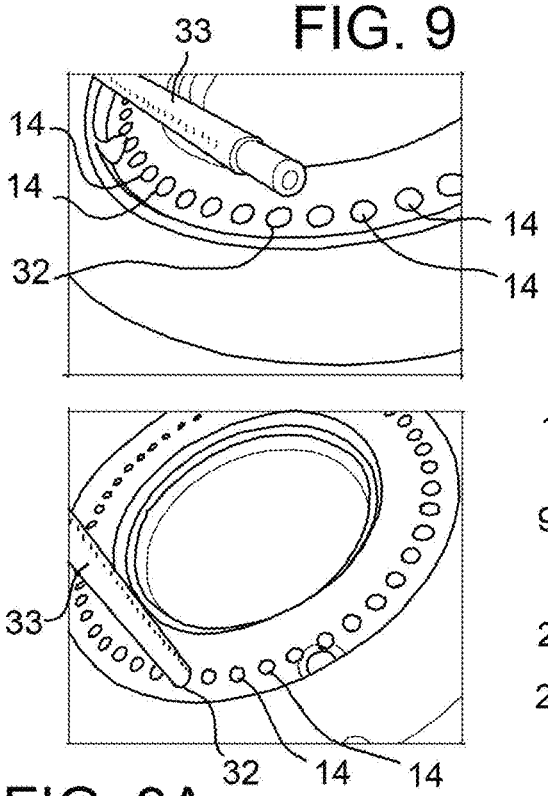
FIG. 9A
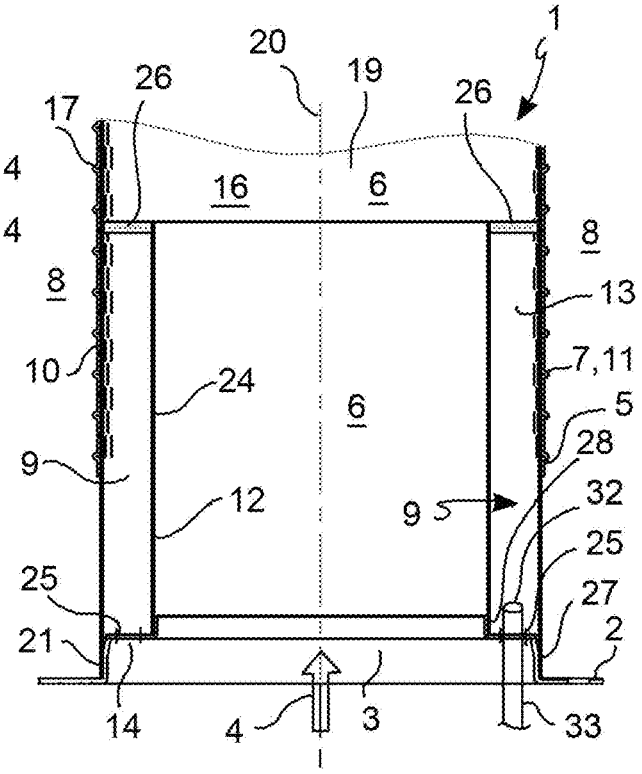
FIG. 8

BURNER

BACKGROUND OF THE INVENTION

This application claims benefit of Serial No. 102021000012668, filed 17 May 2021 in Italy, and which application is incorporated herein by reference. To the extent appropriate, a claim of priority is made to the above-disclosed application.

The present invention relates to a gas burner for a boiler and for industrial applications, in particular a burner with increased power, greater than 200 kW, of the type comprising:

- a support wall which is connectable to a combustion chamber of the boiler or of the industrial application, the support wall having an inlet opening for introducing a mixture of fuel gas and comburent into the burner,
- a tubular diffuser wall having a first end connected to the support wall in flow communication with the inlet opening, a second end closed by a closing base, and a perforation for the passage of the gas mixture from inside the burner to an outer side of the diffuser wall where the combustion occurs.

Premix burners of the type described have disadvantages in terms of operating safety, in particular if sized for increased thermal powers. In the initial ignition step, the burner and the combustion chamber fill up with a significant amount of explosive gas-air mixture initially not involved in a planned combustion. The localized ignition spark may trigger the start of combustion only after reaching a sufficient concentration of a mixture of fuel gas inside and outside the burner and therefore also away from the position of the ignition spark itself. This results in circumstances (pre-ignition steps) in which the burner is filled with, and crossed by undesirably high amounts of explosive gas mixture in the absence of combustion. After ignition, the flame is to propagate from the localized ignition point in multiple directions along the diffuser wall up to reaching and covering the whole combustion surface. Also in this flame propagation step, the gas-air mixture continues leaving the burner and filling the combustion area also away from the burner, increasing the risk of the development of unplanned, unstable and violent combustion.

In these transitional operating steps of the burner, also the signals provided by the ionization sensor (flame detection signal) are not certain and not representative of the actual combustion condition over the whole combustion surface of the burner.

SUMMARY OF THE INVENTION

It is therefore the object of the present invention to provide a gas burner of the type described above or the like, but which is improved and modified so as to overcome at least some of the observed drawbacks of the known art.

Within the scope of the general object, it is a particular object of the invention to improve the known burner so as to reduce the accumulation of explosive gas pre-mixture at the burner in the initial burner pre-ignition and ignition steps.

It is a further particular object of the invention to improve the known burner so as to obtain a more controlled and certain propagation of the just ignited flame, for example from an ignition spark, from the initial ignition position thereof over the remaining combustion surface of the diffuser wall.

It is a further particular object of the invention to improve the known burner with reference to the certainty and reliability of the ionization signal by an ionization sensor confirming the presence of flame in the initial burner ignition step.

According to an aspect of the invention, a gas burner for a boiler and for industrial applications, in particular a burner with increased power, greater than 200 kW, comprises:

- a support wall connectable to a combustion chamber of the boiler or of the industrial application, said support wall forming an inlet passageway for introducing a gas mixture into the burner,
- a diffuser wall which delimits an inner space in flow communication with the inlet passageway and which forms a diffuser perforation for the passage of the gas mixture from the inner space to an outer side of the diffuser wall where the combustion occurs,
- A) a pilot chamber formed in the inner space and delimited by a pilot portion of the diffuser wall, forming a pilot perforation of said diffuser perforation, and by a pilot wall at least partially extended into the inner space, in which the pilot chamber delimits a pilot inner volume and forms:
  - one or more pilot inlet openings for supplying, as required, air alone or a gas-air pre-mixture into the pilot chamber,
  - a pilot gas opening connectable to a non-premixed fuel gas source and leading into the pilot chamber to directly supply non-premixed fuel gas into the pilot chamber,
- B) a main chamber formed in the inner space and delimited by a main portion of the diffuser wall, forming a main perforation of said diffuser perforation, and by said pilot wall, in which the main chamber delimits a main inner volume and is in flow communication with the inlet passageway to supply, as required, air alone or a gas-air pre-mixture into the main chamber, in which the main inner volume is greater than the pilot inner volume and the area of extension of the main perforation is greater than the area of extension of the pilot perforation.

By virtue of providing a separate pilot chamber having smaller dimensions than the main chamber, non-premixed gas may be selectively supplied in the initial ignition step into the pilot chamber alone and non-premixed air into both the pilot and main chambers. This causes a localized mixture of air and fuel gas in the pilot chamber alone at which the ignition may be performed.

With the ignition, first a pilot flame surface is developed, limited to the pilot portion of the diffuser wall, and only subsequently, when the supply of pure air is replaced by a supply of a gas-air pre-mixture, does the flame propagate, simultaneously starting from the whole pilot portion (and not only from one ignition point alone), over the remaining main portion of the diffuser wall.

Accordingly, in the initial ignition step, the burner does not fill up with an undesired amount of explosive gas-air mixture and the initial combustion occurs in the presence of a minimum amount of concentrated gas and a large amount of air.

Therefore, the ignition spark may be generated at a very circumscribed area with a concentrated presence of fuel gas, while the remaining main portion of the diffuser wall is initially only crossed by air. This reduces or eliminates risky circumstances of uncontrolled, unstable or violent ignition in the combustion chamber surrounding the burner.

The ignition in two steps—first at the pilot portion and then at the main portion of the diffuser wall—further ensures an efficient, quick and complete flame propagation over the whole combustion surface.

Finally, in the first ignition step limited to the pilot portion of the diffuser wall, an ionization sensor may detect a flame presence signal which is more reliable and representative of the combustion circumstance therein located.

BRIEF DESCRIPTION OF THE DRAWINGS

In order to better understand the invention and appreciate the advantages thereof, some non-limiting embodiments thereof will be described below with reference to the accompanying drawings, in which:

FIG. 8 is view of a detail, sectioned according to a section plane VIII-VIII in FIG. 4, FIGS. 9, 9A show an air, air-gas pre-mixture and gas supply detail into a pilot chamber of the disassembled and assembled burner, according to an embodiment, FIG. 10 diagrammatically shows a combustion system for a boiler or for a generic industrial application, configured for and comprising a burner according to an embodiment, FIG. 10A shows a function diagram over time of the combustion system and of the burner, according to an embodiment.

DETAILED DESCRIPTION OF THE PREFERRED EMBODIMENT

Figure 1:
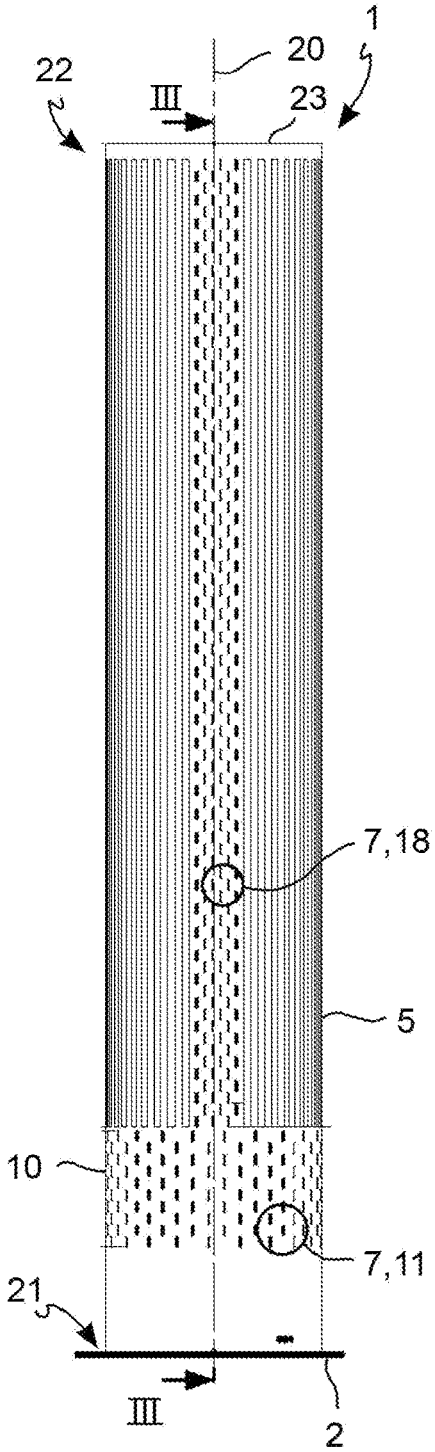
FIG. 1 is a side view of a burner (with no outer fabric or outer mesh) according to an embodiment of the invention.
Figure 2:
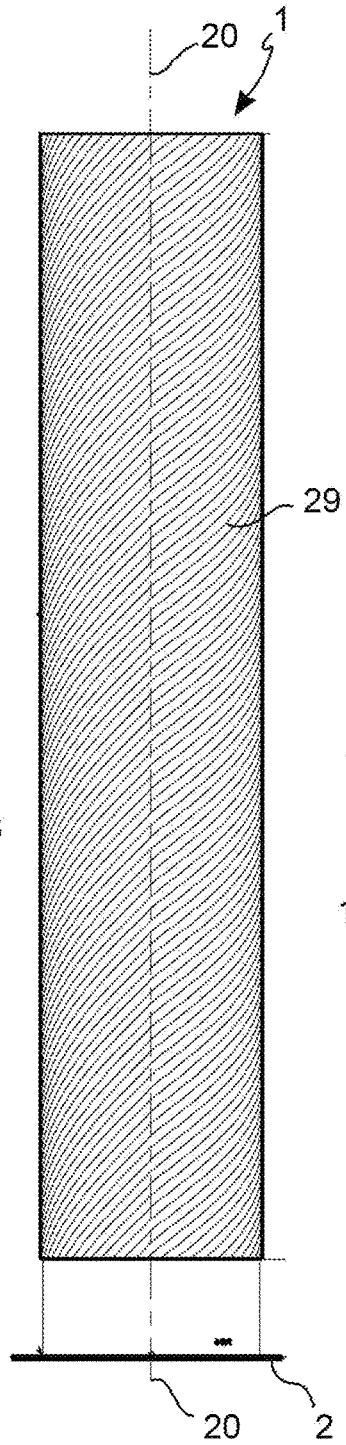
FIG. 2 is a side view of a burner (with outer fabric or outer mesh) according to an embodiment of the invention.
Figure 3:
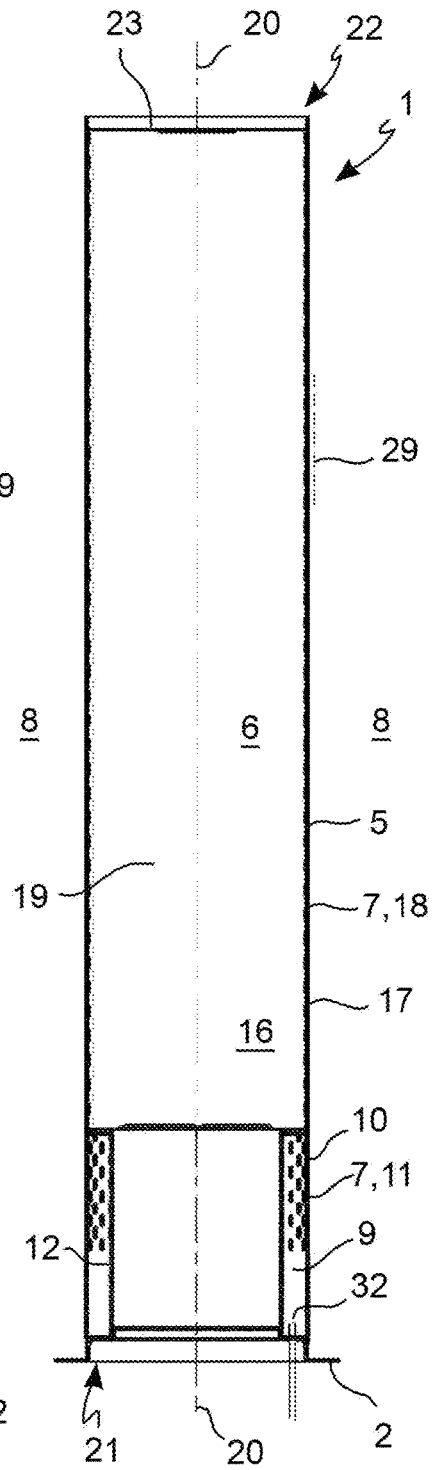
FIG. 3 is a sectional view according to a section plane III-III in FIG. 1.
Figure 4:
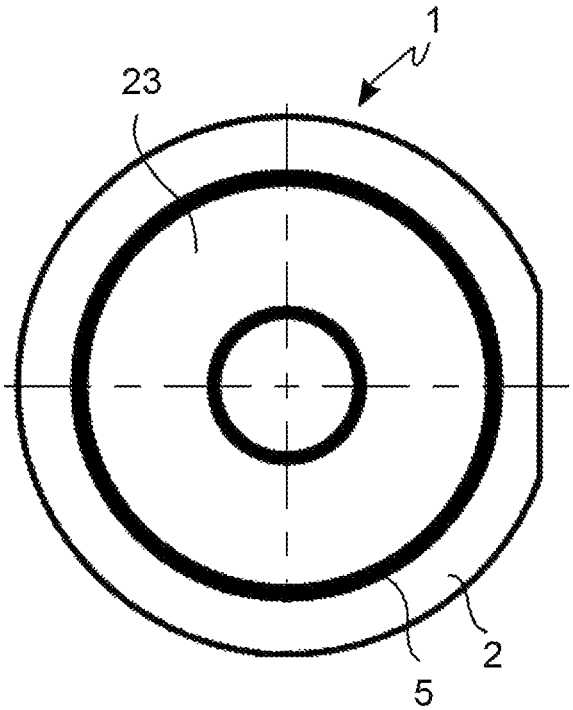
FIG. 4 is a top view of the burner in FIG. 1 or 2.
Figure 5:
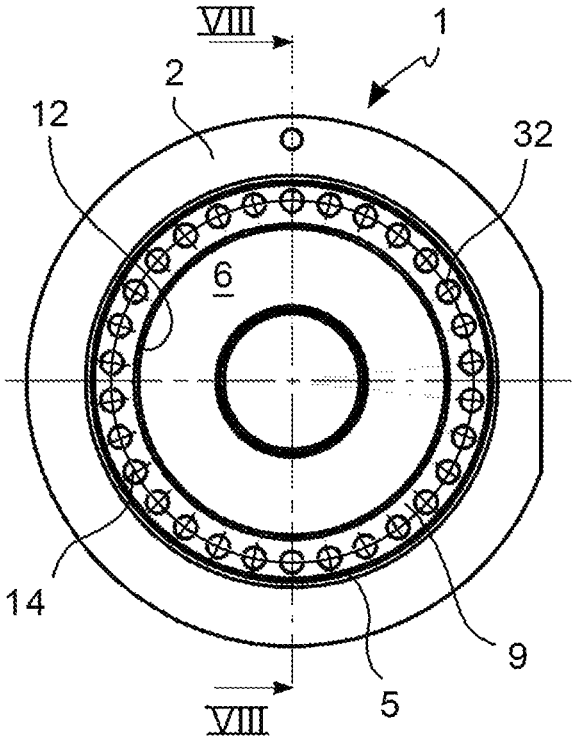
FIG. 5 is a bottom view of the burner according to FIG. 1 or 2.

With reference to the drawings, a gas burner for boilers or for industrial applications which generates heat by the combustion of a fuel gas generally or of a pre-mixture of fuel gas and air in particular, is indicated as a whole by numeral 1. Burner 1 comprises a support wall 2 which is connectable to a combustion chamber of the boiler or of the industrial application, the support wall 2 forming an inlet passageway 3 for introducing a mixture 4 of fuel gas and combustion air into burner 1.

Burner 1 further comprises a diffuser wall 5 which delimits an inner space 6 in flow communication with the inlet passageway 3 and which forms a diffuser perforation 7 for the gas mixture 4 to pass from the inner space 6 to an outer side 8 of the diffuser wall 5 where the combustion occurs.

According to an aspect of the invention, burner 1 comprises a pilot chamber 9 formed in the inner space 6 and delimited by a pilot portion 10 of the diffuser wall 5, forming a pilot perforation 11 of said diffuser perforation 7, and by a pilot wall 12 at least partially extending into the inner space 6.

The pilot chamber 9 delimits a pilot inner volume 13 and forms:

- one or more pilot inlet openings 14 for supplying, as required, air alone or a gas-air pre-mixture into the pilot chamber 9,
- a pilot gas opening 32 which is connectable to a non-premixed fuel gas source 15 and leads into the pilot chamber 9 to directly supply non-premixed fuel gas into the pilot chamber 9.

Burner 1 further comprises a main chamber 16 formed in the inner space 6 and delimited by a main portion 17 of the diffuser wall 5, forming a main perforation 18 of said diffuser perforation 7, and by said pilot wall 12, in which the main chamber 16 delimits a main inner volume 19 and is in flow communication with the inlet passageway 3 to supply, as required, air alone or a gas-air pre-mixture into the main chamber 16.

Advantageously, the main inner volume 19 is greater than the pilot inner volume 13 and the area of extension of the main perforation 18 is greater than the area of extension of the pilot perforation 11.

According to one embodiment, the diffuser wall 5 is tubular, coaxial to a longitudinal axis 20 of burner 1, and has a first end 21 connected to the support wall 2 in flow communication with the inlet passageway 3, and a second end 22 which is closed, for example by a closing base 23.

The pilot wall 12 comprises:

- a tubular wall portion 24 arranged in, and preferably coaxial with the diffuser wall 5,
- an annular front wall portion 25 extending between the diffuser wall 5 and the tubular wall portion 24 on a front side of the pilot chamber 9 facing the inlet passageway 3,
- an annular rear wall portion 26 extending between the diffuser wall 5 and the tubular wall portion 24 on a rear side of the pilot chamber 9 facing the second closed end 22 of the diffuser wall 5, and giving the pilot chamber 9 an annular shape (shape of a hollow cylinder).

According to an embodiment, the pilot inlet openings 14 are formed in the front wall portion so as to directly face the flow of air or gas-air pre-mixture entering in the inner space 6 of burner 1 through the inlet passageway 3.

Advantageously, the pilot inlet openings 14 preferably are circular and may be arranged in one or more successions of (for example, 6, 8, 10 or 12, 15, 29) holes, circumferential with respect to the longitudinal axis 20.

The pilot gas opening 32 may be a hole, preferably in the front wall portion 25, through which a tube or gas nozzle 33 extends. Two or more pilot gas openings 32 may be provided.

The front wall portion 25 preferably is annular circular and may be formed in one piece with the support wall 2 or is connected thereto, for example by welding or press-fitting, or is welded to the tubular wall portion 24 and wedged or placed side-by-side in contact against the inner surface of the diffuser wall 5.

According to an embodiment, the tubular wall portion 24 has no openings to prevent or limit a leak of gas or gas-air mixture from the inside of the pilot chamber 9 into the main chamber 16.

The tubular wall portion 24 advantageously is cylindrical tubular, but may also be polygonal tubular, oval tubular or frustoconical tubular.

According to embodiments, one or both portions of front 25 or rear 26 walls may be formed by end stretches of the tubular wall portion 24 which are radially outwardly bent or inclined.

The rear wall portion 26 preferably is annular circular and may be formed, for example by an annular metal disc welded to the tubular wall portion 24 and wedged or placed side-by-side in contact against the inner surface of the diffuser wall 5.

Also, the rear wall portion 26 advantageously has no openings to minimize a leak of gas or gas-air mixture from the inside of the pilot chamber 9 into the main chamber 16.

According to a preferred embodiment, the pilot chamber 9 is placed adjacent to the first end 21 of the diffuser wall 5, on the side of the inlet passageway 3 of burner 1.

Advantageously, the ratio of the area of extension of the main perforation 18 to the area of extension of the pilot perforation 11 (not considering the net passageway area as area of extension, rather as the total surface area including the holes and the base material of the diffuser wall) is greater than 6, preferably greater than 8, or even more preferably, greater than 9.

Accordingly, in the embodiment with cylindrical diffuser wall 5, the ratio of the length of the main chamber 16 in direction of the longitudinal axis 20 to the length of the pilot chamber 9 in direction of the longitudinal axis 20 advantageously is greater than 6, preferably greater than 8, even more preferably, greater than 9.

Advantageously, the ratio of the diameter of the cylindrical diffuser wall 5 to the diameter of the cylindrical tubular wall portion 24 is in the range from 1.1 to 1.5, preferably from 1.2 to 1.4, more preferably from 1.30 to 1.36.

The support wall 2 is made of metal sheet, for example steel, and forms:

- an outer circumferential seat 27 (circumferential step) facing the outside of burner 1 and adapted to accommodate a front edge of the diffuser wall 5,
- an inner circumferential seat 28 or an inner tubular edge axially protruding into the inner space 6 and adapted to accommodate a front edge of the tubular wall portion 24 to ensure a correct positioning thereof, According to an embodiment, the diffuser wall 5 consists of a perforated steel metal sheet and is cylindrical or slightly frustoconical in shape. Additionally, or alternatively, the perforated steel metal sheet of the diffuser wall 5 may be externally covered by an outer layer of mesh or fabric 29 made of metallic or ceramic or sintered material, which provides or acts in conjunction with the outer surface of the diffuser wall 5 on which the combustion occurs.

According to an aspect that is advantageously applicable to all embodiments, the pilot perforation 11 (or the pilot portion 10) has a lesser porosity (ratio of net passageway area of the openings to the total surface area) than the porosity of the main perforation 18 (or the main portion 17).

In this manner, in the initial ignition step, a sufficient storage duration and on-the-spot mixing of the gas and air introduced into the pilot chamber 9 is ensured prior to the mixture passing through the pilot perforation 11 towards the position of the ignition spark.

Figure 6:
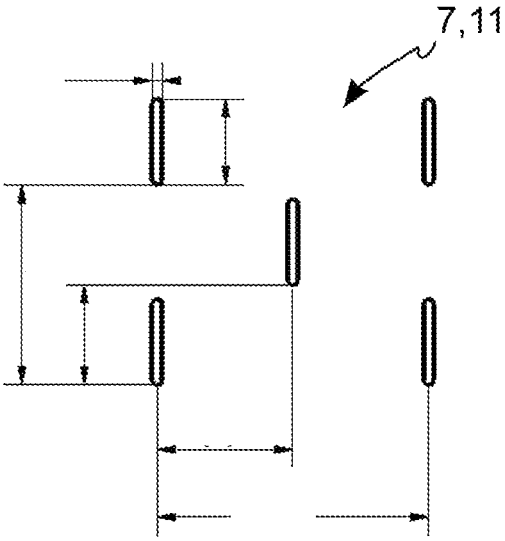
FIG. 6 shows perforation detail of a pilot portion of a diffuser wall of the burner according to an embodiment.
Figure 7:
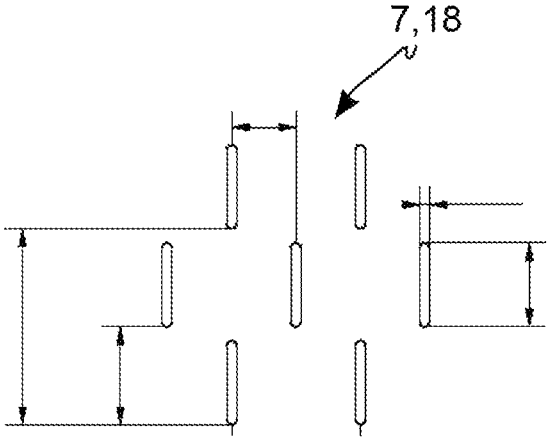
FIG. 7 shows perforation detail of a main portion of a diffuser wall of the burner according to an embodiment.
Figure 11:
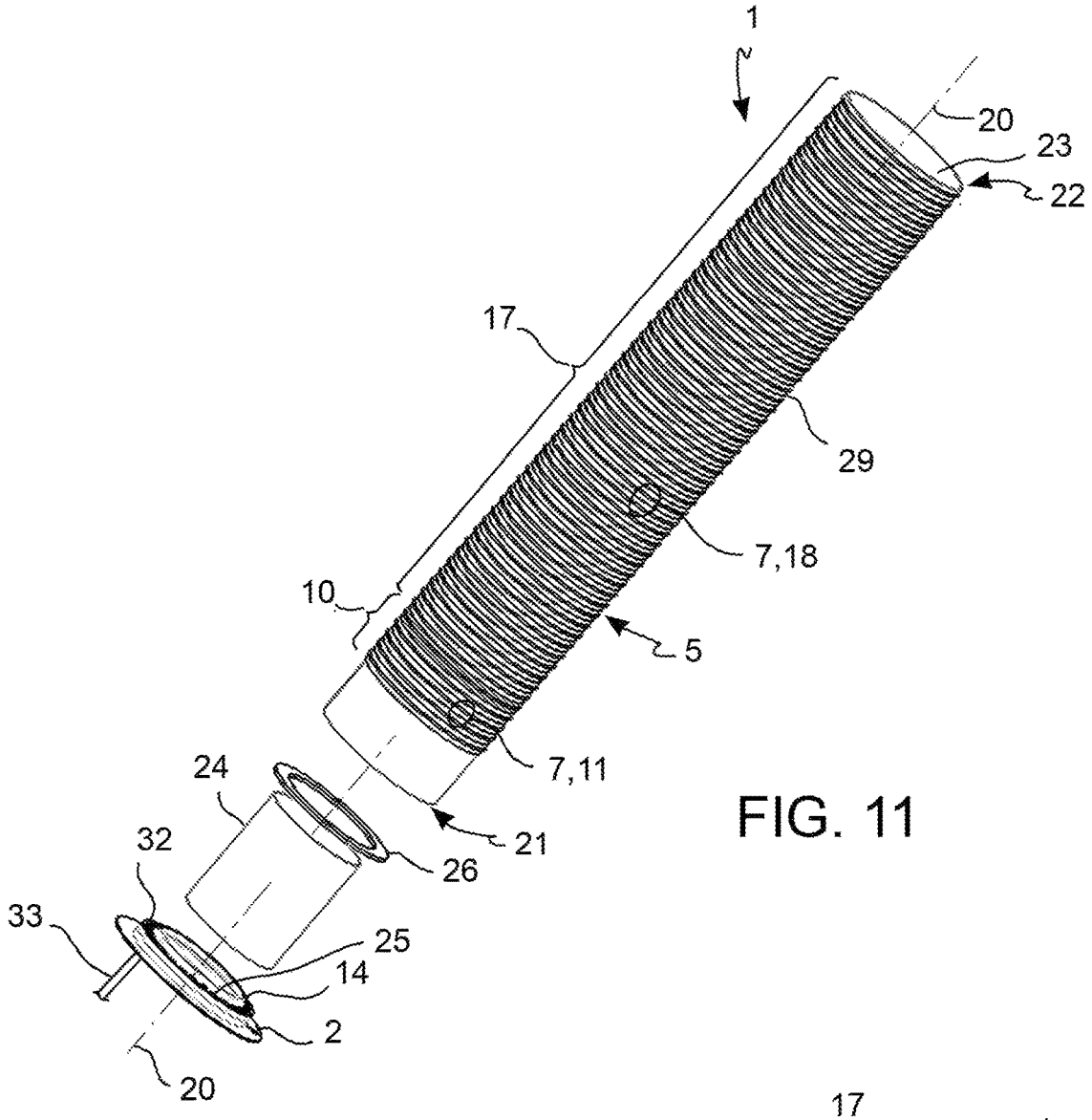
FIG. 11 is an exploded perspective view of a (cylindrical) burner according to an embodiment.
Figure 12:
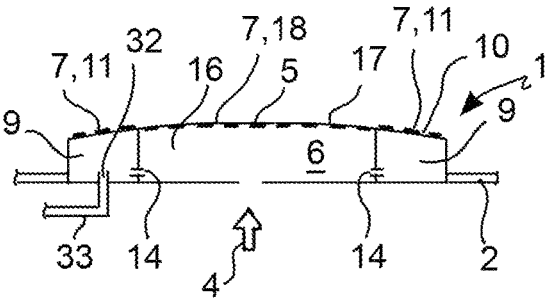
FIG. 12 is a sectional view of a (flat, curved) burner according to a further embodiment.
Figure 13:
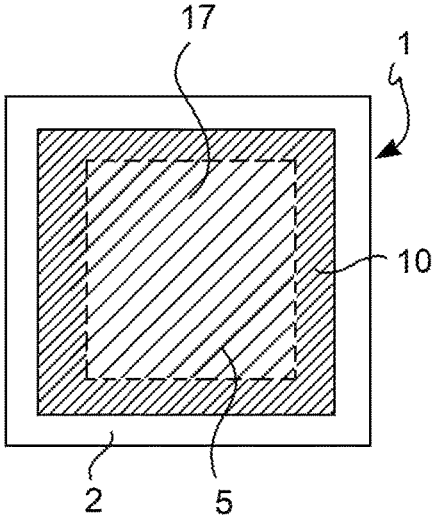
FIG. 13 is a top view of the (flat, curved) burner in FIG. 12.

By way of non-limiting example (FIGS. 6, 7), the individual holes or slits of the pilot perforation 11 may be identical to those of the main perforation 18, but the distance between the individual holes or slits in the pilot perforation 11 may be larger than the distance between the individual holes or slits in the main perforation 18.

Advantageously, the porosity (ratio of passageway area/total area) of the pilot portion 10 is in the range from 2% to 4% and the porosity of the main portion 17 is in the range from 6% to 8%.

According to an alternative embodiment, the diffuser wall 5 may be flat or convexly curved towards the outer side 8 of the burner and form a peripheral edge 30 connected to the support wall 2 which is in flow communication with the inlet passageway 3.

In this embodiment, the pilot chamber 9 preferably is formed along a peripheral region 31 of the diffuser wall 5, advantageously all around, and the pilot perforation 11 extends all around the main perforation 18.

The invention also relates to a combustion system 34, comprising:

- the burner 1,
- a gas-air premixing device 43, for example a Venturi ejector, having a gas inlet 45, an air inlet 46, and a mixture outlet 47,
- a main gas duct 35 with a main gas valve 36 which is connectable to a fuel gas source and is in communication with the gas inlet 45 of the gas-air premixing device 43,
- an air duct 37 with an optional air filter 38, in communication with the air inlet 46 of the gas-air premixing device 43,
- a pilot gas duct 39 with a pilot gas valve 40 in communication with a gas nozzle 33 arranged at the pilot gas opening 32 of burner 1,
- a conveyor 44 interposed between and in communication with the mixture outlet 47 of the premixing device 43 and the inlet passageway 3 of burner 1,
- an ignition device 48, for example an ignition electrode adapted to generate an ignition spark, arranged on the outer side 8 of burner 1 at the pilot portion 10 of the diffuser wall 5,
- an ionization sensor 49, for example the same ignition electrode, arranged on the outer side 8 of burner 1 at the pilot portion 10 of the diffuser wall 5,
- an electronic control system 50 in signal connection with the ionization sensor 49 and configured to control the conveyor 44, the main gas valve 36, the pilot gas valve 40, and the ignition device 48, so that:
  - in a first step of igniting the burner 1, conveyor 44 conveys air alone not mixed with gas through the inlet passageway 3 and the pilot inlet openings 14 into the pilot chamber 9 and into the main chamber 16, the pilot gas duct 39 feeds fuel gas through the pilot gas opening 32 only into the pilot chamber 9, the ignition device generates ignition sparks,
  - in a subsequent ignition step, after a detection of flame presence by the ionization sensor 49, conveyor 44 conveys a gas-air pre-mixture through the inlet passageway 3 and the pilot inlet openings 14 into the pilot chamber 9 and into the main chamber 16, the pilot gas valve 40 interrupts the gas supply through the pilot gas duct 39 so that the flames propagate from the pilot portion 10 over the whole main portion 17 of the diffuser wall 5.

The invention also relates to a combustion control method which uses the combustion system 34 and comprises the method steps described with reference to the electronic control system 50 and herein not repeated for brevity of disclosure.

Obviously, those skilled in the art, in order to meet contingent and specific needs, may make further changes and variants to the burner according to the present invention, all falling within the scope of protection of the invention, as defined by the following claims.

The invention claimed is:

1. A burner, comprising:

a support wall which is connectable to a combustion chamber and forms an inlet passageway for introducing a mixture of fuel gas and combustion air into the burner;

a diffuser wall which delimits an inner space in flow communication with the inlet passageway and which forms a diffuser perforation for the gas mixture to pass from the inner space to an outer side of the diffuser wall where the combustion occurs;

a pilot chamber formed in the inner space and delimited by a pilot portion of the diffuser wall, forming a pilot perforation of said diffuser perforation, and by a pilot wall at least partially extending into the inner space;

wherein the pilot chamber delimits a pilot inner volume and forms:

one or more pilot inlet openings for supplying air alone or a gas-air pre-mixture into the pilot chamber, a pilot gas opening which is connectable to a non-premixed fuel gas source and leads into the pilot chamber to directly supply non-premixed fuel gas into the pilot chamber, a main chamber formed in the inner space and delimited by a main portion of the diffuser wall, forming a main perforation of said diffuser perforation, and by said pilot wall, wherein the main chamber delimits a main inner volume and is in flow communication with the inlet passageway to supply air alone or a gas-air pre-mixture into the main chamber;

wherein the main inner volume is greater than the pilot inner volume and an area of extension of the main perforation is greater than an area of extension of the pilot perforation;

wherein the diffuser wall is tubular and coaxial with a longitudinal axis of the burner, the diffuser wall having a first end connected to the support wall and in fluid communication with the inlet passageway, and a closed second end; and wherein the pilot wall comprises:

a tubular wall portion arranged in the inner space;

an annular front wall portion extending between the diffuser wall and the tubular wall portion on a front side of the pilot chamber facing the inlet passageway;

an annular rear wall portion extending between the diffuser wall and the tubular wall portion on a rear side of the pilot chamber facing the second closed end of the diffuser wall; and wherein the pilot chamber has an annular shape.

2. A burner according to claim 1, wherein the pilot inlet openings are formed in the front wall portion to directly face the flow of air or gas-air pre-mixture entering in the inner space of the burner through the inlet passageway.

3. A burner according to claim 1, wherein the pilot inlet openings are rounded and arranged in at least a circumferential sequence with respect to the longitudinal axis.

4. A burner according to claim 1, wherein the pilot gas opening is a hole in the pilot wall or in the front wall portion through which a tube or gas nozzle extends.

5. A burner according to claim 1, wherein the front wall portion is formed in one piece with the support wall or is connected to the support wall by welding or press-fitting, or is welded to the tubular wall portion and wedged or placed side-by-side in contact against the inner surface of the diffuser wall.

6. A burner according to claim 1, wherein the rear wall portion consists of an annular metal disc welded to the tubular wall portion and wedged or placed side-by-side in contact against the inner surface of the diffuser wall.

7. A burner according to claim 1, wherein the tubular wall portion and the rear wall portion have no openings.

8. A burner according to claim 1, wherein the pilot chamber is placed adjacent to the first end of the diffuser wall on the side of the inlet passageway of the burner.

9. A burner according to claim 1, wherein a ratio of the area of extension of the main perforation to the area of extension of the pilot perforation is greater than 6.

10. A burner according to claim 1, wherein the pilot perforation has less porosity than a porosity of the main perforation, or a porosity, being a ratio of passageway area/total area, of the pilot portion is in the range from 2% to 4% and the porosity of the main portion is in the range from 6% to 8%.

11. A burner according to claim 1, wherein:

the diffuser wall is flat or convexly curved towards the outer side of the burner and forms a peripheral edge connected to the support wall which is in flow communication with the inlet passageway.

12. A burner according to claim 1, comprising two or more of said pilot gas openings.

13. A burner according to claim 1, wherein:

the diffuser wall is flat or convexly curved towards the outer side of the burner and forms a peripheral edge connected to the support wall which is in flow communication with the inlet passageway;

the pilot chamber is formed along a peripheral region of the diffuser wall and the pilot perforation extends about the main perforation.

14. A burner according to claim 1, wherein a ratio of the area of extension of the main perforation to the area of extension of the pilot perforation is greater than 8.

15. A burner according to claim 1, wherein a ratio of the area of extension of the main perforation to the area of extension of the pilot perforation is greater than 9.

16. A combustion system, comprising:

the burner according to claim 1;

a gas-air premixing device having a gas inlet, an air inlet, and a mixture outlet;

a main gas duct with a main gas valve which is connectable to a fuel gas source and is in communication with the gas inlet of the gas-air premixing device;

an air duct in communication with the air inlet of the gas-air premixing device;

a pilot gas duct with a pilot gas valve in communication with a gas nozzle arranged at the pilot gas opening of the burner;

a conveyor interposed between and in communication with the mixture outlet of the premixing device and the inlet passageway of the burner;

an ignition device arranged on the outer side of the burner at the pilot portion of the diffuser wall;

an ionization sensor arranged on the outer side of the burner at the pilot portion of the diffuser wall;

an electronic control system in signal connection with the ionization sensor and configured to control the conveyor, the main gas valve, the pilot gas valve, and the ignition device;

wherein to ignite the burner, the conveyor is configured to convey air alone and unmixed with gas through the inlet passageway and the pilot inlet openings into the pilot chamber and into the main chamber, the pilot gas duct is configured to feed fuel gas through the pilot gas opening only into the pilot chamber, and the ignition device is configured to generate ignition sparks; and after a detection of flame presence by the ionization sensor, the conveyor is configured to convey a gas-air premixture through the inlet passageway and the pilot inlet openings into the pilot chamber and into the main chamber, and the pilot gas valve is configured to interrupt the gas supply through the pilot gas duct so that the flames propagate from the pilot portion over the whole main portion of the diffuser wall.

* * * * *